US009970263B2

(12) United States Patent
Lopez et al.

(10) Patent No.: US 9,970,263 B2
(45) Date of Patent: May 15, 2018

(54) INTERNAL ADJUSTMENTS TO AUTONOMOUS INFLOW CONTROL DEVICES

(71) Applicant: Halliburton Energy Services, Inc., Houston, TX (US)

(72) Inventors: Jean-Marc Lopez, Plano, TX (US); Scott Cunningham, Grapevine, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 728 days.

(21) Appl. No.: 14/382,804

(22) PCT Filed: Nov. 11, 2013

(86) PCT No.: PCT/US2013/069464

§ 371 (c)(1),
(2) Date: Sep. 4, 2014

(87) PCT Pub. No.: WO2015/069295

PCT Pub. Date: May 14, 2015

(65) Prior Publication Data

US 2016/0230509 A1 Aug. 11, 2016

(51) Int. Cl.
*E21B 41/00* (2006.01)
*E21B 43/08* (2006.01)
(Continued)

(52) U.S. Cl.
CPC ..... *E21B 41/00* (2013.01); *E21B 34/063* (2013.01); *E21B 34/14* (2013.01); *E21B 43/08* (2013.01); *E21B 43/10* (2013.01); *E21B 43/12* (2013.01)

(58) Field of Classification Search
CPC ..... E21B 34/063; E21B 43/10; E21B 43/08; E21B 43/12
See application file for complete search history.

(56) References Cited

U.S. PATENT DOCUMENTS 4,730,968 A * 3/1988 Diperstein ..... F16B 37/122 411/178
2005/0204540 A1* 9/2005 Lyon ..... F16B 35/04 29/525.01

(Continued)

FOREIGN PATENT DOCUMENTS

WO 2015069295 A1 5/2015

OTHER PUBLICATIONS

International Search Report and Written Opinion for PCT/US2013/069464 dated Aug. 4, 2014.

*Primary Examiner* — Robert E Fuller
*Assistant Examiner* — Steven A MacDonald
(74) *Attorney, Agent, or Firm* — McDermott Will & Emery LLP

(57) ABSTRACT

Disclosed are wellbore flow control devices that allow on-site field adjustments to flow characteristics. One autonomous inflow control device (AICD) assembly includes a base pipe defining one or more flow ports and an interior, at least one AICD arranged on the base pipe and having at least one fluid inlet and an outlet in fluid communication with one of the one or more flow ports, and a plug configured to be arranged in at least one of the at least one fluid inlet and the outlet of the at least one AICD by a well operator on-site.

22 Claims, 4 Drawing Sheets

(51) Int. Cl.

| | |
|---|---|
| ***E21B 43/12*** | (2006.01) |
| ***E21B 34/14*** | (2006.01) |
| ***E21B 43/10*** | (2006.01) |
| ***E21B 34/06*** | (2006.01) |

(56) References Cited

U.S. PATENT DOCUMENTS

| | | | | |
|---|---|---|---|---|
| 2006/0118296 | A1* | 6/2006 | Dybevik | E21B 17/18 166/242.1 |
| 2006/0131033 | A1* | 6/2006 | Bode | E21B 34/08 166/386 |
| 2008/0135249 | A1* | 6/2008 | Fripp | E21B 33/1208 166/285 |
| 2008/0169099 | A1* | 7/2008 | Pensgaard | E21B 33/138 166/285 |
| 2008/0283238 | A1* | 11/2008 | Richards | E21B 23/04 166/228 |
| 2009/0321081 | A1* | 12/2009 | Schramm | E21B 33/1285 166/370 |
| 2010/0051270 | A1 | 3/2010 | Dusterhoft et al. | |
| 2011/0011577 | A1 | 1/2011 | Dusterhoft et al. | |
| 2013/0062072 | A1 | 3/2013 | Alvarez et al. | |
| 2013/0180724 | A1* | 7/2013 | Nguyen | E21B 43/12 166/316 |

* cited by examiner

INTERNAL ADJUSTMENTS TO AUTONOMOUS INFLOW CONTROL DEVICES

BACKGROUND

The present invention generally relates to wellbore flow control devices and, more specifically, to making on-site field adjustments to autonomous inflow control devices.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

Several AICDs are often combined into an AICD system that can be manufactured to particular specifications and/or designs requested by well operators based on production needs for particular well sites. Such design specifications may include the required flow rate of fluids through the AICD system for normal operation. Upon receiving the AICD system at a well site, however, production needs for the well operator or a well site may have changed. For instance, the well operator may learn new information about the well which would necessitate an AICD system configured for different production capabilities. Alternatively, the well operator may desire to use the manufactured AICD system at a different well site where the production needs and/or capabilities are different. Accordingly, it may prove advantageous to have an AICD system that is adjustable on-site by the well operator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention generally relates to wellbore flow control devices and, more specifically, to making on-site field adjustments to autonomous inflow control devices.

Disclosed are various ways for a well operator to make on-site adjustments to autonomous inflow control device assemblies prior to deployment downhole. Plugs may be installed and otherwise inserted into various locations on one or more autonomous inflow control devices of the autonomous inflow control device assembly to thereby adjust the flow characteristics and how much fluid flow will be allowed during production operations. Plugs may be installed by the well operator in either the inlet(s) or the outlet of the autonomous inflow control devices prior to deployment downhole. The autonomous inflow control devices may be accessed either by removing a sleeve, or via the interior of the base pipe where the autonomous inflow control devices are installed. As a result, a well operator may have the ability to strategically adjust fluid flow capabilities of an autonomous inflow control device assembly in the field.

As used herein, the term "on-site" refers to a rig location or field location where an autonomous inflow control device (AICD) system or assembly may be delivered and otherwise following its discharge from a manufacturer's facility. The term may also refer to any location that the AICD system or assembly might encounter or otherwise be located prior to being deployed downhole for operation.

Figure 1:
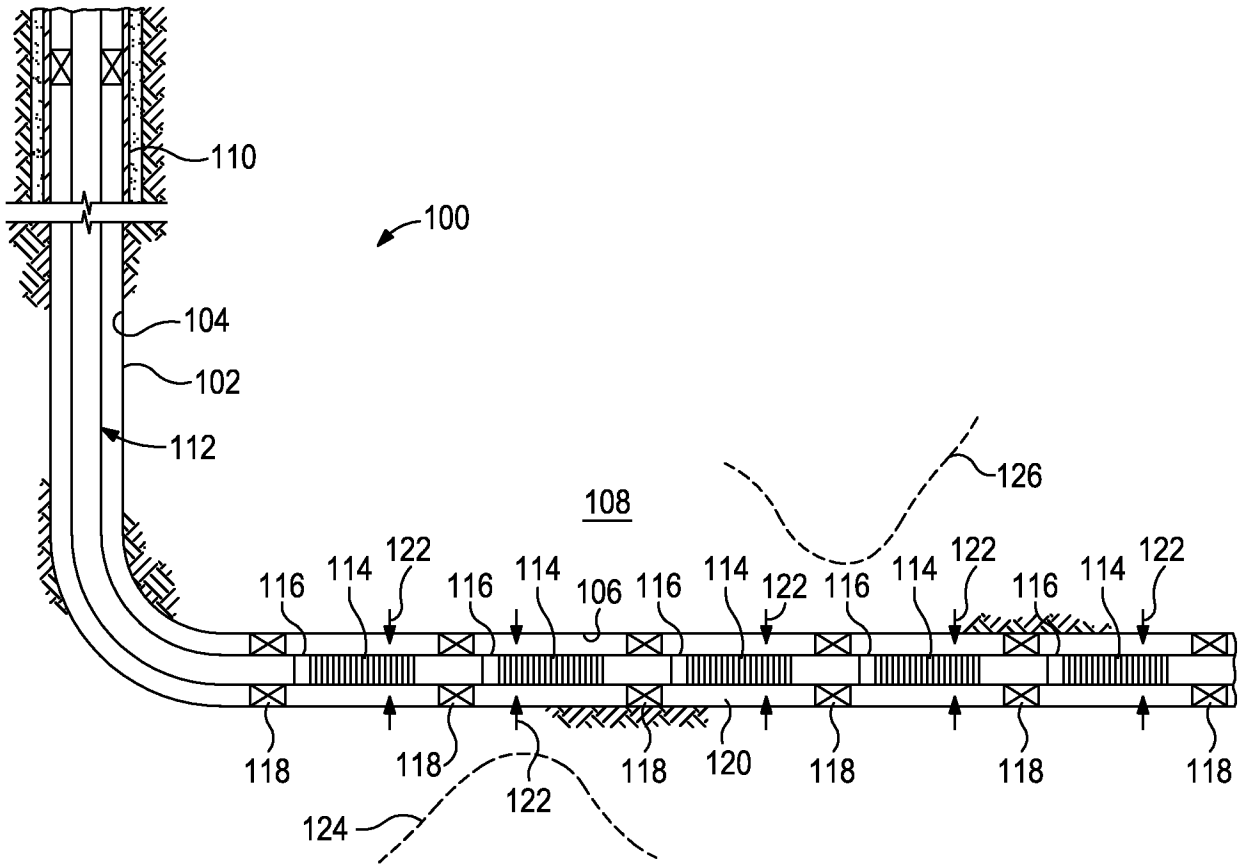
FIG. 1 illustrates a well system that can embody principles of the present disclosure, according to one or more embodiments.

Referring to FIG. 1, illustrated is a well system 100 that can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The flow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Figure 2:
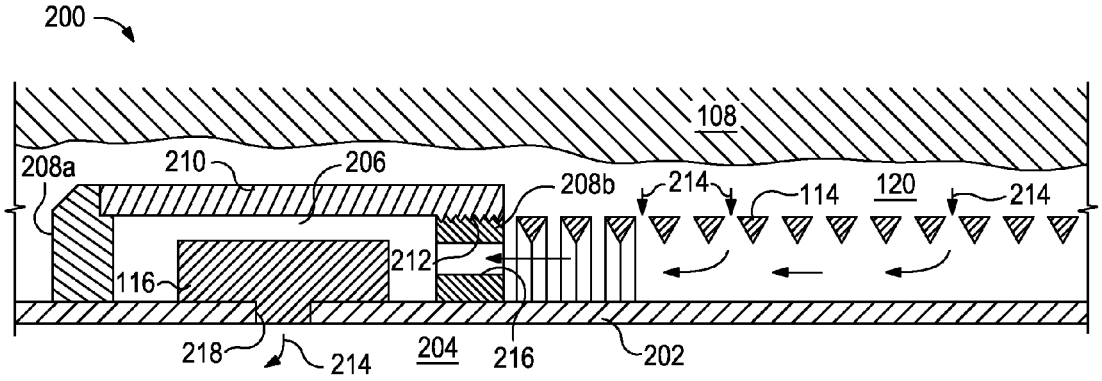
FIG. 2 illustrates an enlarged cross-sectional view of an exemplary autonomous inflow control device assembly, according to one or more embodiments.

Referring now to FIG. 2, with continued reference to FIG. 1, illustrated is an enlarged cross-sectional view of an exemplary autonomous inflow control device assembly 200, according to one or more embodiments. As illustrated, the autonomous inflow control device assembly 200 (hereafter "AICD assembly 200") includes at least one of the flow control devices 116 of FIG. 1, which may be an autonomous flow control device (AICD) designed and otherwise configured to resist the flow of fluids therethrough based on one or more characteristics of the fluid. A portion of one of the well screens 114 is also depicted and may be operably coupled to or otherwise generally arranged about a base pipe 202 having an interior 204. The base pipe 202 may be or otherwise form part of the production tubing 112 of FIG. 1.

The flow control device 116 may be arranged within a fluid compartment 206 generally defined by a first end ring 208*a*, a second end ring 208*b*, a sleeve 210, and the base pipe 202. The first and second end rings 208*a,b* may be generally characterized as structural features of the base pipe 202 that may either be coupled thereto or otherwise form an integral part thereof. In at least one embodiment, the well screen 114 may be coupled to or otherwise extend axially from the second end ring 208*b* about the exterior of the base pipe 202. While only one flow control device 116 is shown in FIG. 2, those skilled in the art will readily recognize that the AICD assembly 200 may include several flow control devices (i.e., AICDs) arranged about the circumference of the base pipe 202 and otherwise within individual fluid compartments corresponding to each flow control device.

In at least one embodiment, the sleeve 210 may extend between the first and second end rings 208*a,b* and generally provide a removable cover for the fluid compartment 206. The sleeve 210 may be coupled to at least one of the end rings 208*a,b* in a variety of ways. For instance, in some embodiments, the sleeve 210 may be mechanically-fastened to at least one of the first and second end rings 208*a,b* using one or more mechanical fasteners (not shown). In other embodiments, as illustrated, the sleeve 210 may be threaded or threadably attached to at least one of the end rings 208*a,b*. For example, the second end ring 208*b* may define or otherwise provide a series of threads 212 configured to mate with corresponding threads defined on the sleeve 210.

In order to expose the fluid compartment 206, and thereby allow a well operator on-site access to the flow control device 116 to make adjustments thereto, the sleeve 210 may be decoupled from one or both of the first and second end rings 208*a,b*, and then subsequently removed in an axial direction with respect to the end rings 208*a,b*. As will be appreciated, exposing the fluid compartment 206 prior to deploying the flow control device 116 (and its associated system or assembly) downhole may prove advantageous in the event a well operator desires to make one or more on-site fluid flow adjustments or modifications to the flow control device 116. For instance, the AICD assembly 200 may arrive at a well site with a particular manufacturer design applied thereto corresponding to predetermined flow characteristics for each flow control device 116. According to the present disclosure, the well operator may be able to access the flow control device(s) 116 via at least the sleeve 210 in order to make certain adjustments to the AICD assembly 200 prior to downhole deployment, and thereby undertake on-site field adjustments to the amount of fluid being introduced into the base pipe 202 during operation. Once the desired on-site fluid flow adjustments have been made, the AICD 200 assembly may then be deployed downhole for operation.

In exemplary operation, a fluid 214 from the annulus 120 may be drawn through the well screen 114 and is thereby filtered before flowing into a flow port or conduit 216 defined in the second end ring 208*b*. The conduit 216 may extend through the second end ring 208*b* and thereby place the fluid compartment 206 in fluid communication with the annulus 120 via the well screen 114. The fluid 214 may be a fluid composition originating from the surrounding formation 108 and may include one or more fluid components, such as oil and water, oil and gas, gas and water, oil, water and gas, etc. Once in the fluid compartment 206, the fluid 214 may enter the flow control device 116 and eventually be discharged therefrom and into the interior 204 of the base pipe 202 via one or more flow ports 218 (one shown) defined in the base pipe 202. In some embodiments, the flow control device 116 may be shrink-fitted into a corresponding flow port 218 and thereby secure the flow control device 116 therein for long-term operation. In other embodiments, however, the flow control device 116 may be threaded, brazed or welded into the corresponding flow port 218, without departing from the scope of the disclosure. As an AICD, the flow control device 116 may resist the flow of the fluid 214 therethrough based on one or more characteristics of the fluid 214, such as the density, the viscosity, and/or the velocity of the fluid 214 or its various fluid components.

Figure 3:
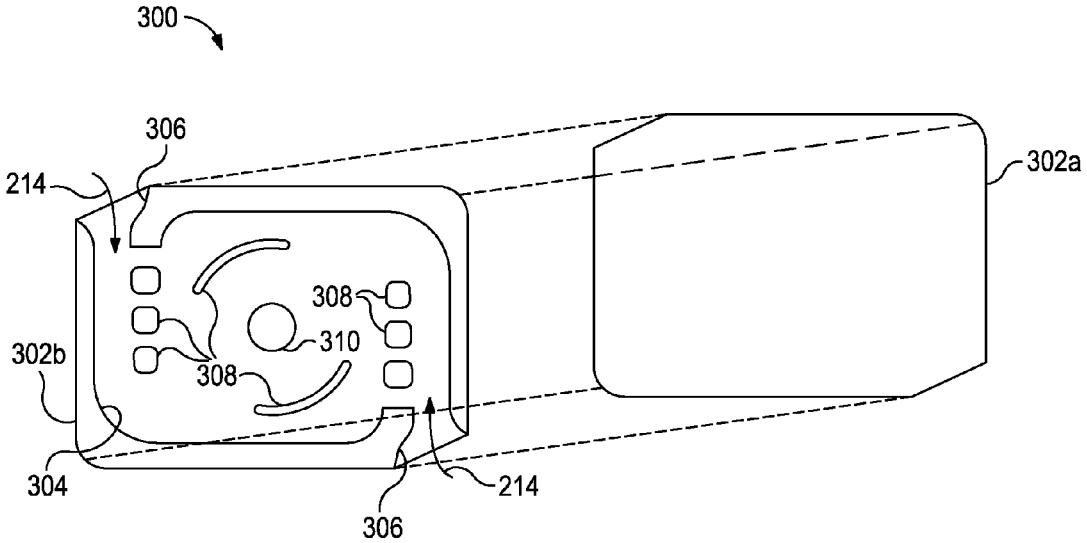
FIG. 3 illustrates an exploded top view of an exemplary autonomous inflow control device, according to one or more embodiments.

Referring now to FIG. 3, with continued reference to FIGS. 1 and 2, illustrated is an exploded top view of an exemplary autonomous inflow control device 300, according to one or more embodiments. The autonomous inflow control device 300 (hereafter "AICD 300") may be one of the flow control devices 116 shown in FIGS. 1 and/or 2, and may be made of, for example tungsten carbide, but may be made of any other materials known to those skilled in the art. It should be noted, however, that the AICD 300 is shown and described merely for illustrative purposes and therefore should not be considered as limiting the present disclosure to the particular design or configuration depicted. Those skilled in the art will readily appreciate that there are several AICD designs and/or configurations that could equally be used in accordance with the principles disclosed herein, without departing from the general scope of this application.

As illustrated, the AICD 300 may include a top plate 302*a* and a bottom plate 302*b*. The top plate 302*a* may be configured to be coupled or otherwise secured to the bottom plate 302*b* in order to define a flow chamber 304 therebetween within the AICD 300. The top plate 302*a* may be coupled to the bottom plate 302*b* using a variety of techniques including, but not limited to, mechanical fasteners, adhesives, welding, brazing, heat shrinking, combinations thereof and the like. In at least one embodiment, however, as will be discussed below, the top plate 302*a* may be coupled to the bottom plate 302*b* by being forced against the bottom plate 302*a* with a structural element arranged radially above it.

The bottom plate 302*b* may define one or more fluid inlets 306 (two shown) that provide fluid access into the flow chamber 304. While two fluid inlets 306 are depicted in FIG. 3, those skilled in the art will readily recognize that the AICD 300 is shown merely for illustrative purposes and other exemplary AICDs that may equally be used may have only one fluid inlet or more than two fluid inlets, without departing from the scope of the disclosure. The fluid inlets 306 may be configured to receive the flow of fluid 214 as it flows into the fluid compartment 206 (FIG. 2) where the AICD 300 may be housed and secured.

The bottom plate 302*b* of the AICD 300 may further provide or otherwise define various internal structures 308 and an outlet 310. The outlet 310 may be centrally-located in the bottom plate 302*b* and may be in fluid communication with one of the flow ports 218 (FIG. 2) of the base pipe 202 (FIG. 2) and otherwise able to deliver the fluid into the base pipe 202. The internal structures 308 may be configured to induce spiraling of the flow of the fluid 214 about the outlet 310. As a result, the fluid 214 may be subjected to centrifugal or vortex forces that may cause various components of the fluid 214 that are more viscous to collect or otherwise congregate more rapidly at the outlet 310, while components of the fluid 214 that are less viscous to flow to the outlet 310 less rapidly. As a result, the AICD 300 may provide a greater resistance to the flow of undesired fluids (e.g., water, gas, etc.) into the base pipe 202 than desired fluids (e.g., oils), particularly as the percentage of the undesired fluids increases.

Figure 4:
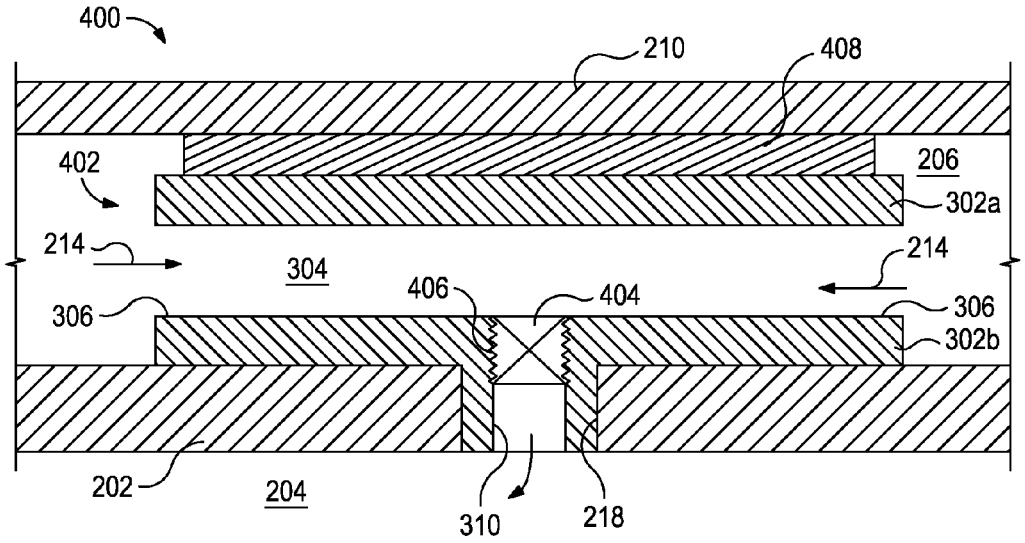
FIG. 4 illustrates a cross-sectional side view of an exemplary autonomous inflow control device assembly, according to one or more embodiments.

Referring now to FIG. 4, with continued reference to FIGS. 2 and 3, illustrated is a cross-sectional side view of an exemplary AICD assembly 400, according to one or more embodiments. As illustrated, the AICD assembly 400 includes at least one exemplary AICD 402 arranged or otherwise secured to the base pipe 202 at one of the flow ports 218. While one AICD 402 is depicted in FIG. 4, it will be appreciated that the AICD assembly 400 may include multiple AICDs arranged about the circumference of the base pipe 202, without departing from the scope of the disclosure. The AICD 402 may be similar in some respects to the AICD 300 of FIG. 3, and therefore will be best understood with reference thereto where like numerals represent like components not described again in detail. During normal operation, for instance, the fluid 214 is able to flow into the flow chamber 304 via the fluid inlets 306 and exit the AICD 402 into the interior 204 of the base pipe 202 via the outlet 310. The AICD 402 may include various internal structures (not shown) that allow the AICD 402 to autonomously discriminate between desired and undesired components of the fluid 214, as generally described above.

In some embodiments, however, it may be desired to restrict or otherwise prevent the fluid 214 from entering the base pipe 202 via the outlet 310 in order to change the fluid flow characteristics of the AICD assembly 400. To accomplish this, the AICD assembly 400 may include a plug 404 that may be inserted into the outlet 310 to substantially occlude the flow port 218 leading into the base pipe 202 and thereby prevent flow into the interior 204 of the base pipe 202 from the AICD 402. The plug 404 may be composed of a ceramic, tungsten carbide, or made from any metal configured to be secured within the outlet 310 by a well operator on-site prior to deploying the AICD assembly 400 downhole. In some embodiments, the plug 404 may be made of a degrading or dissolving material configured to degrade after a predetermined amount of time (e.g., 72-98 hours). Exemplary degrading or dissolving materials include, but are not limited to, polyglycolic acid, polylactic acid, oil-degradable polymers (i.e., polyacrylics, polyamides, and polyolefins such as polyethylene, polypropylene, polyisobutylene, and polystyrene), degradable polymers, dehydrated salts, or a combination thereof. In yet other embodiments, the plug 404 may be made of a material (e.g., a wax) that has a melting point such that it will gradually dissolve when exposed to the temperature of the subterranean formation in which it is placed for operation. In other embodiments, the plug 404 may be a multilayer component having an outer layer configured to degrade in the presence of one fluid and an inner layer configured to degrade in the presence of another fluid. For example, the outer layer could dissolve with an acid and the inner layer could degrade in a wellbore fluid. In yet other embodiments, materials associated with the plug 404 may be configured to degrade as the result of a galvanic reaction. In such embodiments, one form of the material for the plug 404 may be a nanostructured galvanically-reacting material.

In some embodiments, as illustrated, the plug 404 may be threaded into the outlet 310 with mating threads 406 defined on corresponding radial surfaces of the plug 404 and the outlet 310. For instance, the plug 404 may be an NPT (national pipe thread) plug, or the like. In other embodiments, however, the plug 404 may be tapered or generally conical in shape (e.g., a 2-3 degree taper from one end to the other) and configured to be forced into the outlet 310 to generate an interference fit. In yet other embodiments, the plug 404 may be fitted within the outlet 310 using one or more shrink fitting techniques or processes, without departing from the scope of the disclosure.

According to the present disclosure, the plug 404 may installed in the AICD 402 by a well operator on-site prior to deployment of the AICD assembly 400 downhole. To accomplish this, the well operator may be able to access the AICD 400 by first removing the sleeve 210, as generally described above, and thereby exposing the fluid compartment 206. The operator may then be able to remove the top plate 302*a* from the AICD 402 in order to expose the flow chamber 304 and access the outlet 310. In such cases, the top plate 302*a* may be removable from the bottom plate 302*b*, for example, by removing one or more mechanical fasteners or by simply detaching the tope plate 302*a* from the bottom plate 302*b* by hand. The well operator may then install or otherwise insert the plug 404 into the outlet 310, as generally described above, and place the top plate 302*a* back onto the bottom plate 302*b*. In at least one embodiment, as will be described below, the plug 404 may be inserted into the outlet 310 from within the interior 204 of the base pipe 202, without departing from the scope of the disclosure.

Once the plug 404 is properly installed in the outlet 310, the sleeve 210 may then be re-coupled to the first and second end rings 208*a,b* (FIG. 2). In some embodiments, the bottom of the sleeve 210 may engage and force the top plate 302*a* into coupling engagement with the bottom plate 302*b* for downhole operation. In other embodiments, however, a spacer member 408 may be included in the AICD assembly 400 and placed between the top plate 302*a* and the sleeve 210 within the fluid compartment 206 to urge the top plate 302*a* into biasing engagement with the bottom plate 302*b* for downhole operation. The spacer member 408 may be any rigid or semi-rigid material that may extend between the bottom surface of the sleeve 210 and the top surface of the top plate 302*a*. In some embodiments, for example, the spacer member 408 may be made of metal. In other embodiments, however, the spacer member 408 may be made of a rubber or other elastomeric material configured to provide a constant degree of spring force against the top plate 302*a* such that continuous engagement with the bottom plate 302*b* results even in the presence of common downhole temperature fluctuations. In yet other embodiments, the spacer member 408 may be a swellable material configured to increase in size and therefore enhance the engagement between the sleeve 210 and the top plate 302*a*.

As can be appreciated, a well operator on-site may be able to strategically place plugs 404 in corresponding outlets 310 of one or more of the AICDs 402 of the AICD assembly 400 in order to alter the pressure drop into the base pipe 202 and thereby alter the flow characteristics of the AICD assembly 400 as a whole. This may prove advantageous in providing desired production needs and/or capabilities for a particular well.

Figure 5:
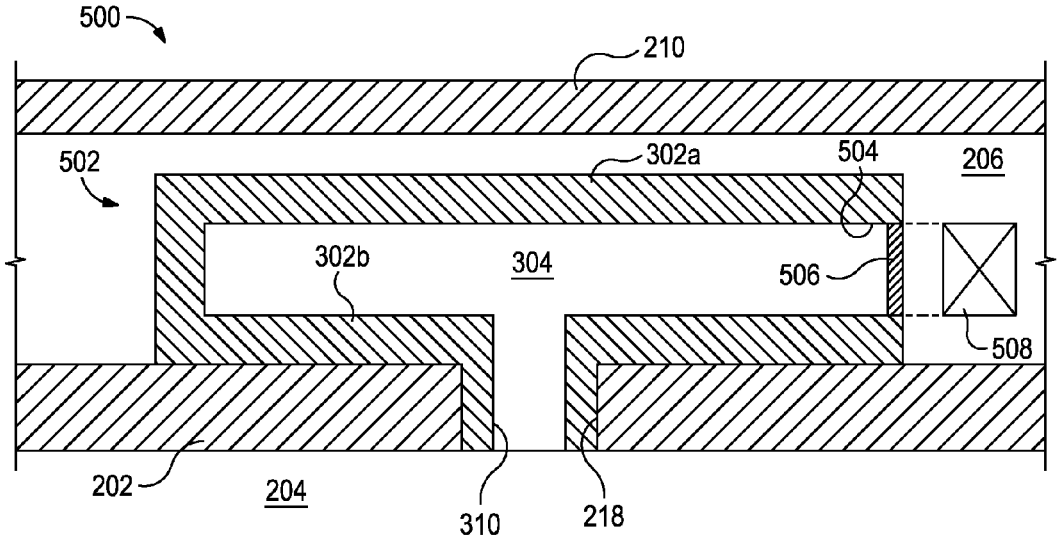
FIG. 5 illustrates a cross-sectional side view of another exemplary autonomous inflow control device assembly, according to one or more embodiments.

Referring now to FIG. 5, with continued reference to FIGS. 2-4, illustrated is a cross-sectional side view of another exemplary AICD assembly 500, according to one or more embodiments. As illustrated, the AICD assembly 500 includes at least one exemplary AICD 502 arranged on or otherwise secured to the base pipe 202 at one of the flow ports 218. Again, while only one AICD 502 is depicted in FIG. 5, it will be appreciated that the AICD assembly 500 may include multiple AICDs, without departing from the scope of the disclosure. Moreover, the AICD 502 may be similar in some respects to the AICD 300 of FIG. 3, and therefore will be best understood with reference thereto where like numerals represent like components not described again in detail. More particularly, the AICD 502 may include various internal structures (not shown) that allow the AICD 502 to autonomously discriminate between desired and undesired components of the fluid 214 (FIGS. 2 and 3).

Unlike the AICD 300 of FIG. 3, however, the AICD 502 may provide or otherwise define only a single fluid inlet 504 between the top and bottom plates 302*a,b* that feeds the flow chamber 304. In some embodiments, the AICD assembly 500 may include a plug 506 in the form of a window (or the like) arranged within the fluid inlet 504 that substantially occludes the fluid inlet 504 into the flow chamber 304. In at least one embodiment, the plug 506 may be an integral part of the structure of the AICD 502 and otherwise manufactured therewith of the same material (e.g., carbide or tungsten carbide). In other embodiments, however, the plug 506 may be placed or otherwise installed in the fluid inlet 504 following or during the manufacture of the AICD 502 or AICD assembly 500. In such embodiments, the plug 506 may be made of a variety of materials including, but not limited to, metals, ceramics, elastomers, composite materials, combinations thereof, and the like. Accordingly, the AICD assembly 500 may be delivered to a rig or well site with the plug 506 pre-installed in the fluid inlet 504.

At the rig or well site, a well operator may have the option of piercing, breaking, or otherwise removing the plug 506 on-site prior to deployment of the AICD assembly 500 downhole in order to increase the fluid flow capacity into the base pipe 202. To accomplish this, the well operator may be able to access the AICD 500 by first removing the sleeve 210 to expose the fluid compartment 206, as generally described above. The well operator may then be able to use a blunt object, such as a hammer or the like, to strike and break the plug 506. The plug 506 may exhibit a thickness that is small enough to allow the plug 506 to be broken easily by the operator on-site, but large enough to allow the plug 506 to operate in downhole conditions in case it is desired to be left intact upon deployment. Alternatively, the well operator may be able to remove the plug 506, such as be unthreading it from the fluid inlet 504 or removing one or more mechanical fasteners (e.g., snap rings, pins, dowels, screws, etc.) used to removably secure the plug 506 within the fluid inlet 504. Once the plug 506 is broken or otherwise removed, fluids may then be able to flow freely into the flow chamber 304 during downhole operation. The well operator may then re-install the sleeve 210 to ready the AICD assembly 500 for deployment downhole with the flow characteristics thereof being strategically altered on-site.

In other embodiments, the window-like plug 506 may be omitted and instead the AICD assembly 500 may be delivered to the rig or well site having the fluid inlet 504 uncovered or otherwise generally open. In such embodiments, a well operator may have the option of plugging the fluid inlet 504 with a plug 508, and thereby preventing fluid flow into the flow chamber 304. The plug 508 may be a carbide or tungsten carbide insert (or made of any metal) configured to be secured within the outlet 310 by a well operator on-site prior to deploying the AICD assembly 500 downhole. In other embodiments, the plug 508 may be made of a degrading or dissolving material configured to degrade after a predetermined amount of time (e.g., 72-98 hours). For instance, in some embodiments, the well operator may inject a fluid that dissolves the plug 506 or a portion thereof. In such embodiments, the fluid used may be a fluid not typically encountered in the construction or operation of a wellbore, such as acetone. Applying the acetone to the plug 506, for example, may be configured to remove an outer layer of the plug 506 that would subsequently allow an inner layer of the plug 506 to degrade downhole. In yet other embodiments, the plug 508 may be made of a material (e.g., a wax) that has a melting point such that it will gradually dissolve when exposed to the temperature of the subterranean formation in which it is placed for operation.

In some embodiments, the plug 508 may be threaded into the fluid inlet 504 with mating threads (not shown) defined on corresponding radial surfaces of the plug 508 and the fluid inlet 504. For instance, the plug 508 may be an NPT (national pipe thread) plug, or the like. In other embodiments, the plug 508 may be tapered or generally conical in shape (e.g., having a 2-3 degree taper from one end toward the other) and configured to be forced or press-fitted into the fluid inlet 504, thereby resulting in an interference fit. In yet other embodiments, the plug 508 may be installed in the fluid inlet 504 using one or more shrink fitting techniques or processes, without departing from the scope of the disclosure. The shape of the plug 508 may generally correspond to the shape of the fluid inlet 504. For instance, the plug 508 may be round, oval, ovoid, square, rectangular, or any other polygonal shape configured to mimic the shape of the fluid inlet 504, without departing from the scope of the disclosure.

At the rig or well site, a well operator may have the option of placing the plug 508 in the fluid inlet 504 on-site prior to the deployment of the AICD assembly 500 downhole in order to decrease the fluid flow into the base pipe 202. Again, to accomplish this, the well operator may be able to access the AICD 500 by first removing the sleeve 210, and then inserting the plug 508 into the fluid inlet 504, as generally described above. The well operator may then re-install the sleeve 210 to ready the AICD assembly 500 for deployment downhole with the flow characteristics thereof strategically altered. As can be appreciated, the well operator may be able to strategically place plugs 508 in the corresponding fluid inlets 504 of multiple AICDs 502 of the AICD assembly 500 in order to alter the pressure drop into the base pipe 202 and thereby adjust the flow characteristics of the AICD assembly 500 as a whole.

Figure 6:
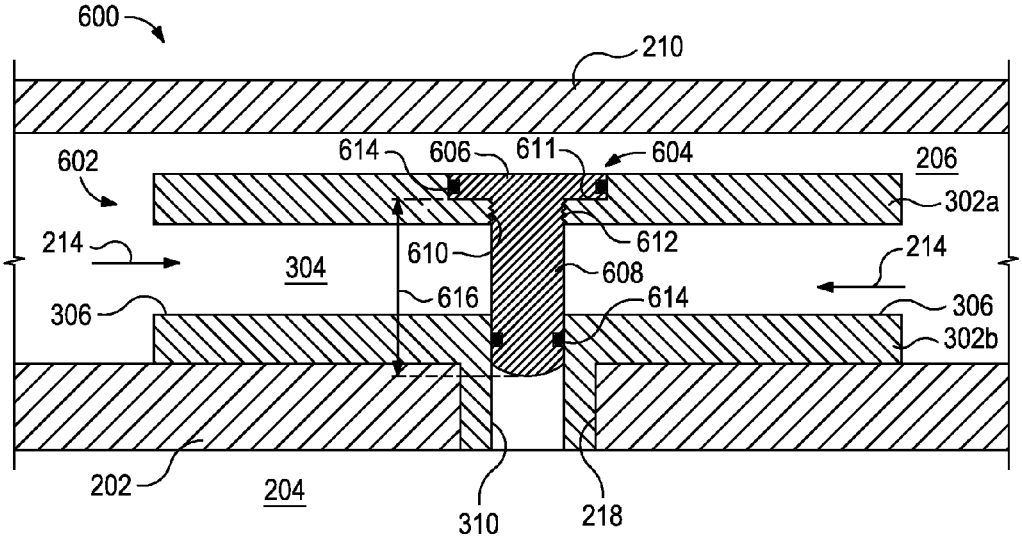
FIG. 6 illustrates a cross-sectional side view of another exemplary autonomous inflow control device assembly, according to one or more embodiments.

Referring now to FIG. 6, with continued reference to FIGS. 1-5, illustrated is a cross-sectional side view of another exemplary AICD assembly 600, according to one or more embodiments. As illustrated, the AICD assembly 600 includes at least one exemplary AICD 602 arranged or otherwise secured to the base pipe 202 at one of the flow ports 218. The AICD 602 may be similar in some respects to the AICD 300 of FIG. 3, and therefore will be best understood with reference thereto where like numerals represent like components not described again in detail. More particularly, the AICD 602 may include various internal structures (not shown) that allow the AICD 602 to autonomously discriminate between desired and undesired components of the fluid 214. Again, while only one AICD 602 is depicted in FIG. 6, it will be appreciated that the AICD assembly 600 may include multiple AICDs arranged about the base pipe 202, without departing from the scope of the disclosure.

The AICD assembly 600 may further include a plug 604 that, in some embodiments, may be configured to extend from the top plate 302*a* and into the outlet 310 of the AICD 602 to substantially prevent fluid flow therethrough. The plug 604 may include a head 606 and a stem 608 that extends longitudinally from the head 606. The plug 604 may be made of any rigid material including, but not limited to, plastics, composites, metals, ceramics, and carbides (e.g., tungsten carbide). In some embodiments, portions of the plug 604, such as the stem 608, may be made of a degrading or dissolving material configured to degrade after a predetermined amount of time (e.g., 72-98 hours). In yet other embodiments, the stem 608 may be made of a material (e.g., a wax) that has a melting point such that it will gradually dissolve when exposed to the temperature of the subterranean formation in which it is placed for operation.

As illustrated, the plug 604 may be configured to be received and secured into a hole 610 centrally-defined in the top plate 302*a* and generally axially-aligned with the outlet 310. In some embodiments, as illustrated, the head 606 may be an annular lip configured to be received and seated within a corresponding radial shoulder 611 of the hole 610 such that the top of the head 606 is seated substantially flush with the top surface of the top plate 302*a* when the plug 604 is properly installed in the hole 610. In other embodiments, the radial shoulder 611 may be omitted and the head 606 may instead be configured to seat on the top surface of the top plate 302*a*, without departing from the scope of the disclosure.

The plug 604 may be removably secured within the hole 610 such that the plug 604 may be removed by a well operator on-site, if desired. In some embodiments, for example, the plug 604 may be threaded into the hole 610 using corresponding mating threads 612 (e.g., NPT threads) defined on opposing radial surfaces of each of the plug 604 and the hole 610. In other embodiments, the mating threads 612 may be defined on the inner radial surface of the outlet 310, without departing from the scope of the disclosure. In yet other embodiments, the threads 612 may be omitted and the plug 604 may instead be held in place with a biasing engagement with the inner surface of the sleeve 210. The plug 604 may further include one or more sealing elements 614 (one shown) arranged on the head 606 and otherwise at an interface of the plug 604 and the hole 610 in order to provide a sealed interface at that location. In some embodiments, the sealing element 614 may be an o-ring, or the like. In other embodiments, the sealing element 614 may be any other type of sealing device known to those skilled in the art that are able to withstand the pressures, temperatures, and corrosive environments of downhole applications.

In some embodiments, the stem 608 may exhibit a length 616 sufficient to extend into the outlet 310 of the AICD 602 and otherwise occlude the outlet 310 when the plug 604 is properly installed in the hole 610. Similar to the head 606, the stem 608 may also include one or more sealing elements 614 (one shown) arranged at the interface of the stem 608 and the outlet 310 in order to provide a sealed interface at that location.

Figure 6A:
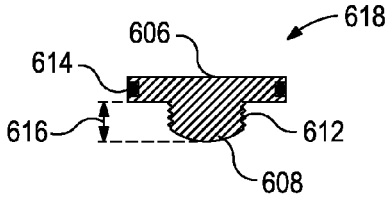
FIG. 6A depicts a cross-sectional view of an exemplary top plug, according to one or more embodiments.

Referring briefly to FIG. 6A, with continued reference to FIG. 6, illustrated is a cross-sectional view of another exemplary plug 618, according to one or more embodiments. The plug 618 may replace the plug 604 in FIG. 6. As illustrated, the plug 618 may include the head 606, the stem 608, the mating threads 612 defined on the stem 608, and the sealing element 614. Unlike the plug 604, however, the plug 618 may not be configured to extend into the outlet 310. More specifically, the length 616 of the stem 608 may be sized such that the stem 608 does not extend out of the hole 610 when the when the plug 618 is installed in the hole 610. In other embodiments, the length 616 of the stem 608 may be sized such that the stem 608 extends only a short distance out of the hole 610 when the when the plug 618 is properly installed in the hole 610, without departing from the scope of the disclosure.

Referring again to FIG. 6, according to the present disclosure, the AICD 602 may be delivered to the rig site or otherwise leave the manufacturer's facility having either of the plugs 604, 618 secured within the hole 610. At the well site, and otherwise prior to deploying the AICD 602 downhole for operation, a well operator may be able to access the AICD 602 and change the plug 604, 618, if desired, and thereby adjust the potential flow rate of fluids 214 into the base pipe 202 for operation. In order to do this, the well operator may be able to access the AICD 602 by first removing the sleeve 210 and thereby exposing the fluid compartment 206. The operator may then be able to remove the plug 604, 618 from the hole 610 in the top plate 302*a* and replace it with a different plug 604, 618. As can be appreciated, the well operator may be able to strategically install the plugs 604, 618 into corresponding holes 610 of each AICD 602 in the AICD assembly 600 in order to alter the pressure drop into the base pipe 202 and thereby alter the overall flow characteristics of the AICD assembly 600.

Figure 7:
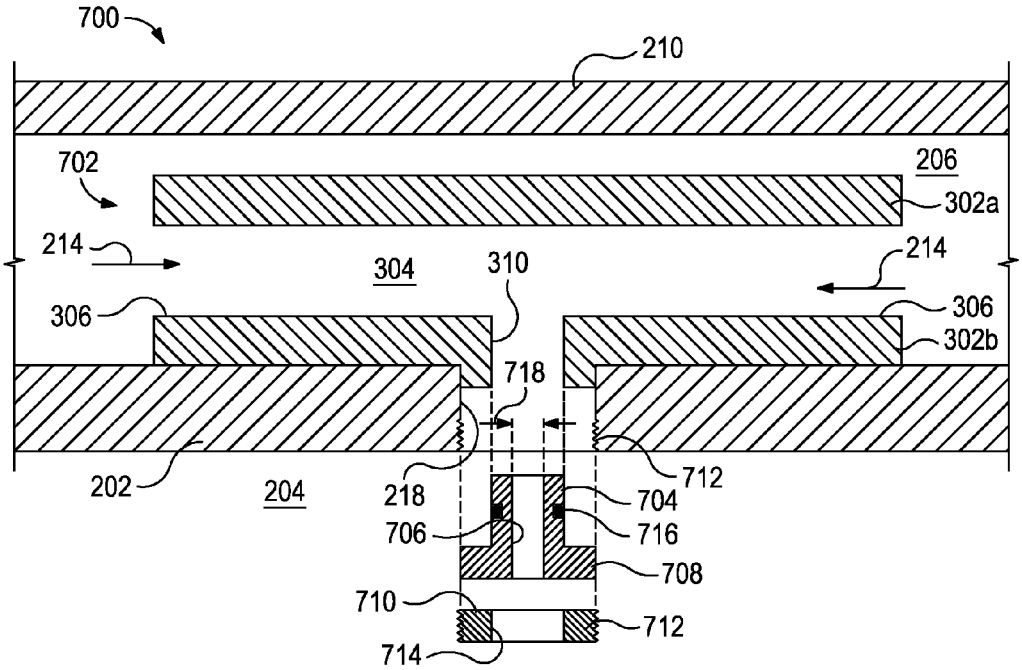
FIG. 7 illustrates a cross-sectional side view of another exemplary autonomous inflow control device assembly, according to one or more embodiments.

Referring now to FIG. 7, with continued reference to the prior figures, illustrated is an exploded, cross-sectional side view of another exemplary AICD assembly 700, according to one or more embodiments. As illustrated, the AICD assembly 700 includes at least one exemplary AICD 702 arranged or otherwise secured to the base pipe 202 at one of the flow ports 218. The AICD 702 may be similar in some respects to the AICD 300 of FIG. 3, and therefore will be best understood with reference thereto. More particularly, the AICD 702 may include various internal structures (not shown) that allow the AICD 702 to autonomously discriminate between desired and undesired components of the fluid 214. Again, while only one AICD 702 is depicted in FIG. 7, it will be appreciated that the AICD assembly 700 may include multiple AICDs arranged about the base pipe 202, without departing from the scope of the disclosure.

Similar to the AICD 402 of FIG. 4, the AICD 702 may include a plug 704 configured to be received within the outlet 310 and regulate the flow of fluids 214 out of the AICD 702 and into the base pipe 202 during operation. Unlike the AICD 402, however, the plug 704 may be received into the outlet 310 via the interior 204 of the base pipe 202. The plug 704 may be a carbide or tungsten carbide insert (or made of any metal) configured to be secured within the outlet 310 by a well operator on-site prior to deploying the AICD assembly 700 downhole. In other embodiments, the plug 704 may be made of a degrading or dissolving material configured to degrade after a predetermined amount of time (e.g., 72-98 hours). In yet other embodiments, the plug 704 may be made of a material (e.g., a wax) that has a melting point such that it will gradually dissolve when exposed to the temperature of the subterranean formation in which it is placed for operation.

In some embodiments, the plug 704 may function as a nozzle and provide or otherwise define a flow conduit 706 that fluidly communicates with the interior 204 (FIG. 2) of the base pipe 202. In at least some embodiments, the flow conduit 706 may be tapered or otherwise chamfered at its top end (i.e., towards the chamber 304) in order to get the flow of the fluid 214 to spin faster. Moreover, the tapered flow conduit 706 may be less susceptible to erosion because of its tapered geometry. As will be appreciated, the size, length, and/or diameter of the flow conduit 706 may directly correspond to the potential flow rate of fluids therethrough.

The plug 704 may be removably secured within the outlet 310 and the flow port 218 by a well operator on-site prior to deploying the AICD assembly 700 downhole. To accomplish this, the well operator may extend the plug 704 into the interior 204 of the base pipe 202 from one end of the base pipe 202 and locate the flow port 218. This can be done, for example, with a rod (not shown) or similar mechanism having axial depth markings thereon that correspond to the axial depth of the flow port 218 within the interior 204 of the base pipe 202 from one end. Once the proper axial depth marking on the rod is reached, the well operator may then manipulate the rod in order to extend the plug 704 radially into the flow port 218 and the outlet 310. In some embodiments, the plug 704 may be extended into the flow port 218 until a radial shoulder 708 defined on the plug 704 contacts the AICD 702.

A lock nut 710 may then be threaded into the flow port 218 in order to secure the plug 704 in place. Similar to the plug 704, the lock nut 710 may be located at the proper flow port 218 within the interior 204 of the base pipe 202 by using the rod with predetermined axial depth markings depicted thereon. In some embodiments, the plug 704 and the lock nut 710 may be axially located at the proper flow port 218 simultaneously with the rod. As illustrated, corresponding mating threads 712 may be defined on opposing radial surfaces of each of the lock nut 710 and the flow port 218. The lock nut 710 may then be threaded into the flow port 218 using, for example, a dremel-style rotary drilling mechanism that is capable of threading at a right angle. The lock nut 710 may further define a central channel 714 in fluid communication with the flow conduit 706 and otherwise configured to allow the fluid 214 to pass therethrough as it proceeds out of the flow conduit 706. Moreover, the plug 704 may further include one or more sealing elements 716 arranged at the interface of the plug 704 and the outlet 310, wherein the sealing element 716 may be similar to the sealing element 614 (FIG. 2) in order to provide a sealed interface at that location.

As mentioned above, the size, length, and/or diameter of the flow conduit 706 defined within the plug 704 may dictate the potential flow rate of the fluid 214 therethrough during operation. For instance, the flow conduit 706 of the plug 704 may exhibit a diameter 718 that allows a predetermined amount of fluid 214 therethrough. Other plugs (not shown) that include flow conduits may exhibit a different diameter 718 and thereby result in another predetermined amount of fluid 214 that is able to pass therethrough and into the base pipe 202. Accordingly, a well operator may be able to strategically choose the size of the plug 704 for each of the AICDs of the AICD assembly 700 in order to intelligently regulate the flow of the fluid 214 into the base pipe 202.

It will be appreciated, however, that in other embodiments the plug 704 may be installed in the outlet 310 by removing the sleeve 210 and the top plate 302*a*, similar to the embodiments disclosed in FIG. 4, without departing from the scope of the disclosure.

Embodiments disclosed herein include:

A. An autonomous inflow control device (AICD) assembly that includes a base pipe defining one or more flow ports and an interior, at least one AICD arranged on the base pipe and having at least one fluid inlet and an outlet in fluid communication with one of the one or more flow ports, and a plug configured to be arranged in at least one of the at least one fluid inlet and the outlet of the at least one AICD by a well operator on-site.

B. A method that includes receiving an autonomous inflow control device (AICD) assembly subsequent to its manufacture, the AICD assembly including a base pipe defining one or more flow ports and an interior, manipulating a plug while on-site in at least one of a fluid inlet and an outlet of an AICD arranged on the base pipe, the outlet being in fluid communication with one of the one or more flow ports, and deploying the AICD assembly into a wellbore after manipulating the plug.

Each of embodiments A and B may have one or more of the following additional elements in any combination: Element 1: further comprising a sleeve mechanically coupled to the base pipe and configured to be removed by the well operator on-site to provide access to the AICD, wherein the AICD comprises a top plate, and a bottom plate in engagement with the top plate to define a flow chamber therebetween. Element 2: wherein the sleeve is at least one of mechanically-fastened and threaded to a structural feature connected to the base pipe. Element 3: further comprising a spacer member interposing the top plate and the sleeve, the spacer member being configured to urge the top plate into engagement with the bottom plate when secured with the sleeve. Element 4: wherein the spacer member is made of at least one of a metal and an elastomer. Element 5: wherein the plug has at least one wall and the plug extends through a hole defined in the wall and includes a head and a stem extending longitudinally from the head and into the outlet to substantially occlude the one of the one or more flow ports. Element 6: wherein the plug is made of at least one of a metal, a carbide, a degrading material, and a dissolving material. Element 7: wherein the plug is at least one of threaded into the at least one fluid inlet or the outlet, press-fitted into the at least one fluid inlet or the outlet, bonded in the at least one fluid inlet or the outlet, and shrink-fitted into the at least one fluid inlet or the outlet. Element 8: wherein the plug is a window arranged in the at least one fluid inlet and exhibits a thickness configured to allow the well operator to break the window on-site and thereby allow fluids to pass through the at least one AICD. Element 8: wherein the plug is installed proximate the outlet by the well operator on-site via the interior of the base pipe and the one of the one or more flow ports. Element 9: wherein the plug defines a flow conduit therethrough that fluidly communicates with the interior of the base pipe and exhibits a diameter corresponding to a predetermined flow rate of a fluid therethrough. Element 10: further comprising a lock nut configured to be threaded into the one of the one or more flow ports to secure the plug in the outlet.

Element 11: further comprising removing a sleeve mechanically coupled to the base pipe and radially offset from the AICD, wherein the AICD comprises a top plate engaged with a bottom plate and defining a flow chamber therebetween. Element 12: wherein removing the sleeve comprises at least one of removing one or more mechanical fasteners and unthreading the sleeve from its mechanical connection with the base pipe. Element 13: further comprising re-coupling the sleeve to the base pipe, placing a spacer member between the top plate and the sleeve, and urging the top plate into engagement with the bottom plate with the spacer member when the sleeve is coupled to base pipe. Element 14: wherein the plug includes a head and a stem extending longitudinally from the head, and wherein manipulating the plug comprises extending the plug through a hole defined in the top plate, and extending the stem into the outlet to substantially occlude the one of the one or more flow ports. Element 15: wherein manipulating the plug comprises at least one of threading the plug into the at least one fluid inlet or the outlet, press-fitting the plug into the at least one fluid inlet or the outlet, bonding the plug in the at least one fluid inlet or the outlet, and shrink-fitting the plug into the at least one fluid inlet or the outlet. Element 16: wherein the plug is a window arranged in the at least one fluid inlet, and wherein manipulating the plug comprises breaking the window on-site to allow fluids to pass through the AICD. Element 17: wherein manipulating the plug while on-site comprises extending the plug into the interior of the base pipe from an end of the base pipe and to the one of the one or more flow ports, and installing the plug in the outlet via the interior of the base pipe and the one of the one or more flow ports. Element 18: wherein the plug defines a flow conduit therethrough, the method further comprising flowing a fluid through the flow conduit, the flow conduit fluidly communicating with the interior of the base pipe and exhibiting a diameter corresponding to a predetermined flow rate of the fluid. Element 19: further comprising threading a lock nut into the one of the one or more flow ports and thereby securing the plug in the outlet.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An inflow control device (ICD) assembly, comprising:

a base pipe defining one or more flow ports and an interior;

at least one ICD arranged on the base pipe and having at least one fluid inlet and an outlet in fluid communication with one of the one or more flow ports, wherein the ICD comprises:

a top plate; and a bottom plate detachably engaged with the top plate to define a flow chamber therebetween, the bottom plate defining the outlet; and a plug configured to be arranged in at least one of the at least one fluid inlet and the outlet of the at least one ICD by a well operator on-site.

2. The ICD assembly of claim 1, further comprising a sleeve mechanically coupled to the base pipe and configured to be removed by the well operator on-site to provide access to the ICD.

3. The ICD assembly of claim 2, wherein the sleeve is at least one of mechanically-fastened and threaded to a structural feature connected to the base pipe.

4. The ICD assembly of claim 2, further comprising a spacer member interposing the top plate and the sleeve, the spacer member being configured to urge the top plate into engagement with the bottom plate when secured with the sleeve.

5. The ICD assembly of claim 4, wherein the spacer member is made of at least one of a metal and an elastomer.

6. The ICD assembly of claim 2, wherein the top plate has at least one wall and the plug extends through a hole defined in the wall and includes a head and a stem extending longitudinally from the head and into the outlet to substantially occlude the one of the one or more flow ports.

7. The ICD assembly of claim 1, wherein the plug is made of at least one of a metal, a carbide, a degrading material, and a dissolving material.

8. The ICD assembly of claim 1, wherein the plug is at least one of threaded into the at least one fluid inlet or the outlet, press-fitted into the at least one fluid inlet or the outlet, bonded in the at least one fluid inlet or the outlet, and shrink-fitted into the at least one fluid inlet or the outlet.

9. The ICD assembly of claim 1, wherein the plug is a window arranged in the at least one fluid inlet and exhibits a thickness configured to allow the well operator to break the window on-site and thereby allow fluids to pass through the at least one ICD.

10. The ICD assembly of claim 1, wherein the plug is installed proximate the outlet by the well operator on-site via the interior of the base pipe and the one of the one or more flow ports.

11. The ICD assembly of claim 10, wherein the plug defines a flow conduit therethrough that fluidly communicates with the interior of the base pipe and exhibits a diameter corresponding to a predetermined flow rate of a fluid therethrough.

12. The ICD assembly of claim 10, further comprising a lock nut configured to be threaded into the one of the one or more flow ports to secure the plug in the outlet.

13. A method, comprising:

receiving an inflow control device (ICD) assembly subsequent to its manufacture, the ICD assembly including a base pipe defining one or more flow ports and an interior, and an ICD arranged on the base pipe, wherein the ICD comprises:

a top plate; and a bottom plate detachably engaged with the top plate to define a flow chamber therebetween, the bottom plate defining an outlet;

manipulating a plug while on-site in at least one of a fluid inlet and the outlet of the ICD, the outlet being in fluid communication with one of the one or more flow ports; and deploying the ICD assembly into a wellbore after manipulating the plug.

14. The method of claim 13, further comprising removing a sleeve mechanically coupled to the base pipe and radially offset from the ICD.

15. The method of claim 14, wherein removing the sleeve comprises at least one of removing one or more mechanical fasteners and unthreading the sleeve from its mechanical connection with the base pipe.

16. The method of claim 15, further comprising:

re-coupling the sleeve to the base pipe;

placing a spacer member between the top plate and the sleeve; and urging the top plate into engagement with the bottom plate with the spacer member when the sleeve is coupled to base pipe.

17. The method of claim 14, wherein the plug includes a head and a stem extending longitudinally from the head, and wherein manipulating the plug comprises:

extending the plug through a hole defined in the top plate; and extending the stem into the outlet to substantially occlude the one of the one or more flow ports.

18. The method of claim 14, wherein manipulating the plug comprises at least one of threading the plug into the at least one fluid inlet or the outlet, press-fitting the plug into the at least one fluid inlet or the outlet, bonding the plug in the at least one fluid inlet or the outlet, and shrink-fitting the plug into the at least one fluid inlet or the outlet.

19. The method of claim 14, wherein the plug is a window arranged in the at least one fluid inlet, and wherein manipulating the plug comprises breaking the window on-site to allow fluids to pass through the ICD.

20. The method of claim 14, wherein manipulating the plug while on-site comprises:

extending the plug into the interior of the base pipe from an end of the base pipe and to the one of the one or more flow ports; and installing the plug in the outlet via the interior of the base pipe and the one of the one or more flow ports.

21. The method of claim 20, wherein the plug defines a flow conduit therethrough, the method further comprising flowing a fluid through the flow conduit, the flow conduit fluidly communicating with the interior of the base pipe and exhibiting a diameter corresponding to a predetermined flow rate of the fluid.

22. The method of claim 20, further comprising threading a lock nut into the one of the one or more flow ports and thereby securing the plug in the outlet.

* * * * *